United States Patent [19]

Simons

[11] Patent Number: 4,711,368

[45] Date of Patent: Dec. 8, 1987

[54] TAMPER PROOF PACKAGE WITH ELECTRICAL CIRCUIT

[76] Inventor: Leon Simons, 303 E. 57th St. Apt. 47-E, New York, N.Y. 10022

[21] Appl. No.: 883,245

[22] Filed: Jul. 9, 1986

Related U.S. Application Data

[63] Continuation-in-part of Ser. No. 850,327, Apr. 11, 1986, abandoned.

[51] Int. Cl.[4] ..... B65D 55/02

[52] U.S. Cl. ..... 220/450; 116/100; 206/534; 206/807; 215/201; 220/449; 324/525; 324/557; 340/537; 340/572; 368/10

[58] Field of Search ..... 206/528, 531, 534, 807; 368/10; 220/403, 450, 449; 340/537, 568, 572; 324/525, 557, 554; 215/201, 252; 116/100

[56] References Cited

U.S. PATENT DOCUMENTS

| | | | |
|---|---|---|---|
| 480,038 | 8/1892 | Rudd | 324/525 |
| 956,046 | 4/1910 | Davis | 220/450 |
| 2,019,393 | 10/1935 | Carah | 340/568 |
| 3,878,941 | 4/1975 | Kelner | 206/419 |
| 4,243,932 | 1/1981 | Kakumoto et al. | 324/557 |
| 4,329,681 | 5/1982 | Parsons | 340/568 |
| 4,333,577 | 6/1982 | Mumford | 215/252 X |
| 4,526,474 | 7/1985 | Simon | 368/10 |
| 4,584,571 | 4/1986 | Smit et al. | 340/572 |
| 4,617,557 | 10/1986 | Gordon | 340/568 |

*Primary Examiner*—Stephen Marcus
*Assistant Examiner*—Bryon Gehman
*Attorney, Agent, or Firm*—Blum Kaplan

[57] ABSTRACT

A tamper proof package for determining whether or not a package has been opened or tampered with before opening the package is provided. The package has an electrical conductor of known resistance which is so positioned that any attempt to open the package or to tamper with the contents destroys all or part of the conductor. The resistance of the conductor can be measured at the time of sale or during the shelf life of the package to determine whether or not the package has been opened or tampered with.

7 Claims, 17 Drawing Figures

FIG. 1
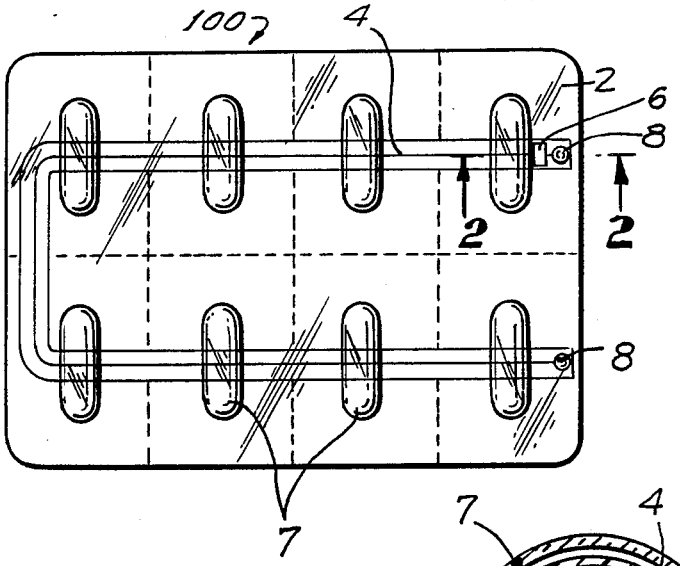
FIG. 2
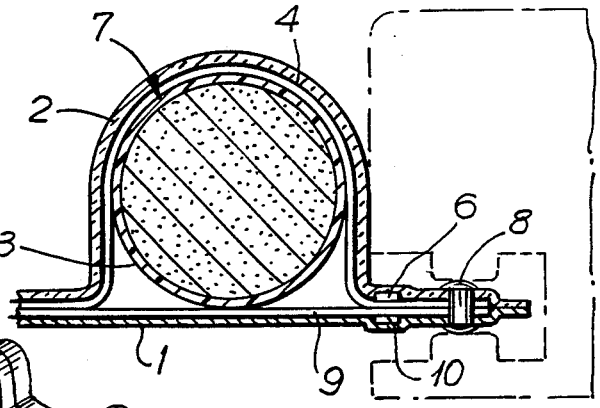
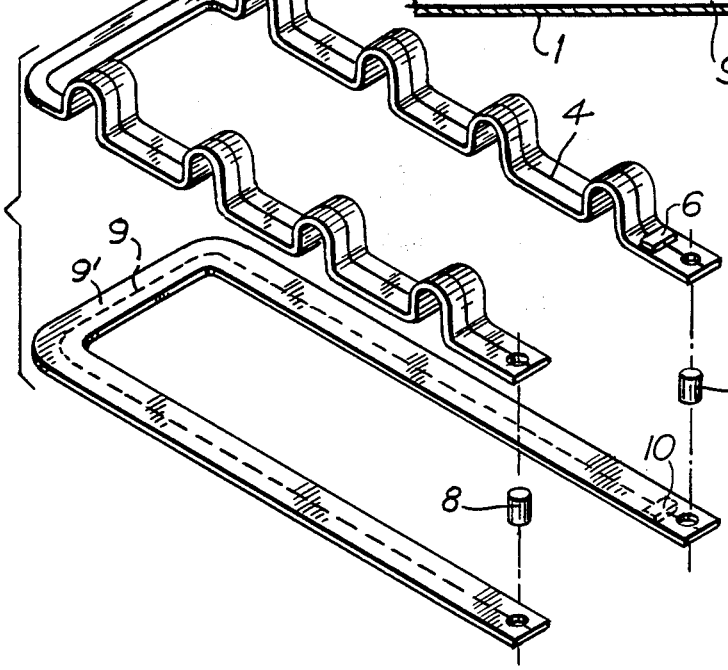
FIG. 3

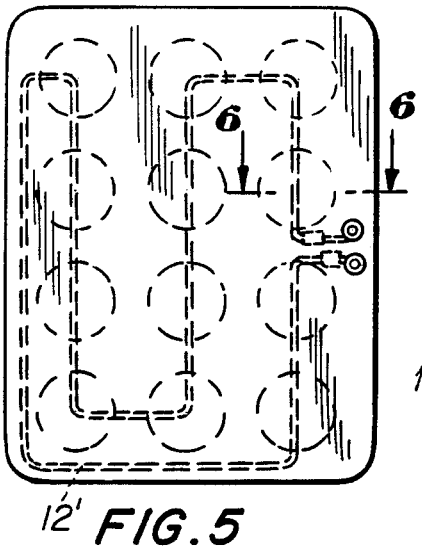
FIG. 5
FIG. 4
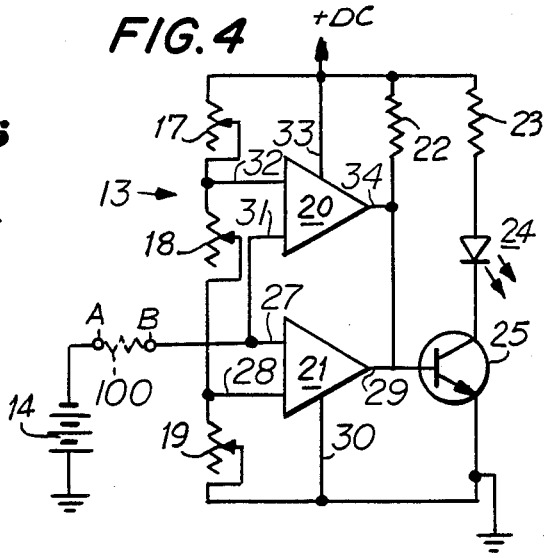
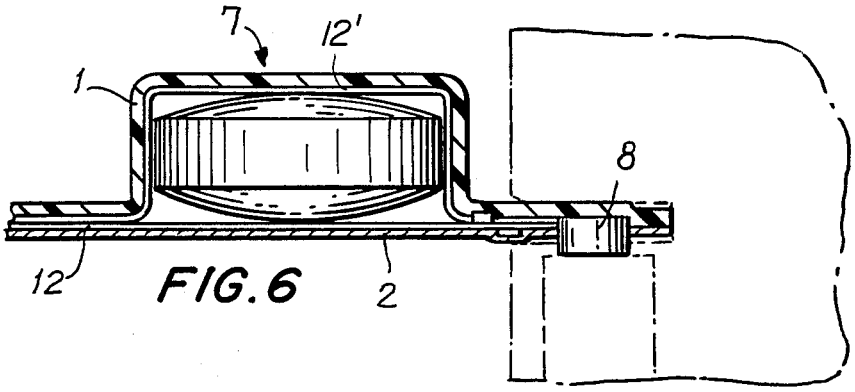
FIG. 6
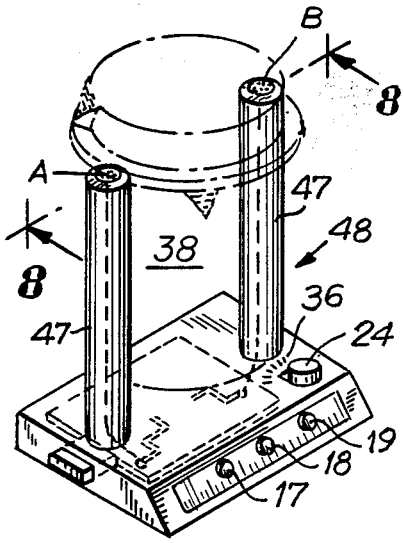
FIG. 7

FIG. 8
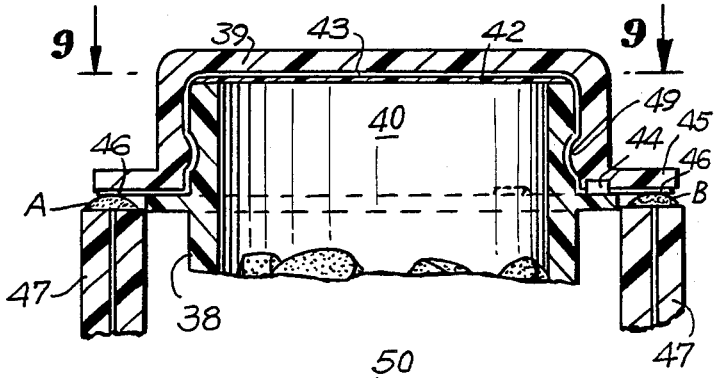
FIG. 9
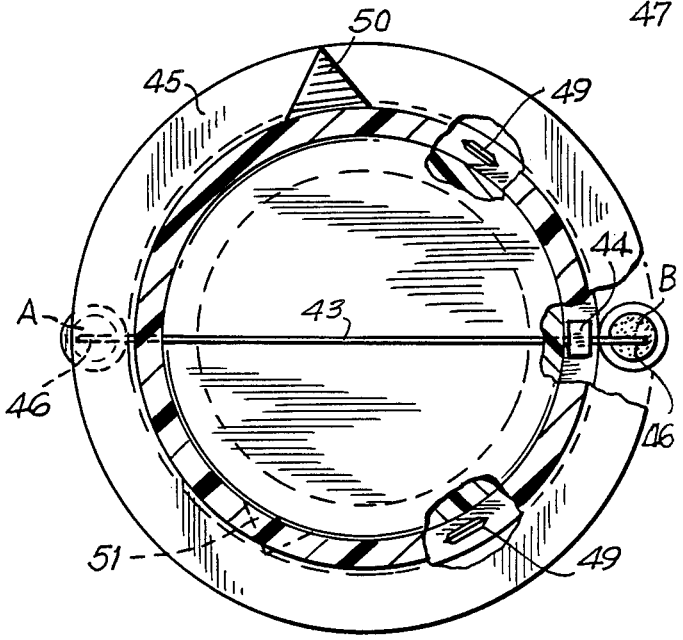
FIG. 10
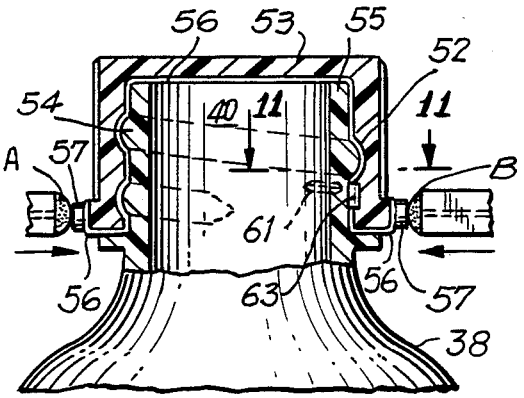
FIG. 11
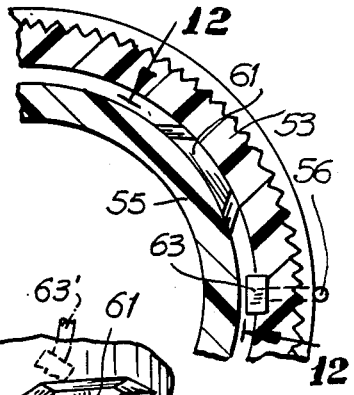
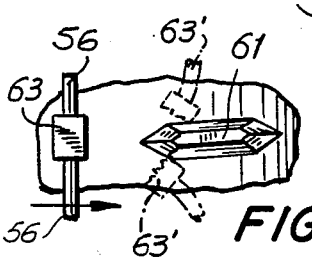
FIG. 12

TAMPER PROOF PACKAGE WITH ELECTRICAL CIRCUIT

BACKGROUND OF THE INVENTION

This application is a continuation-in-part of application Ser. No. 850,327 filed Apr. 11, 1986, now abandoned.

This invention relates in general to packages for small items and, in particular, to so-called tamper-proof packages.

Tamper-proof packages are well known in the art, especially in packages designed for capsules, pills, or the like. Such packages generally rely on visible means for showing whether the package has been tampered with. Such packages also have utility for packaging foods. For example, with tamper-proof bottles, the tamper protection system usually consists of enclosing part or all of bottle, or a portion thereof, in a cellophane or plastic wrap. Therefore, the bottle cannot be opened without breaking the wrap, thereby showing the consumer that the bottle has been tampered with. A second system of detecting tampering, in use either alone or in combination with the foregoing system, consists of covering the neck of the bottle with a foil. In order to tamper with the pills in the bottle, the foil must be pierced or broken. The consumer, after opening the package and upon seeing any piercing or breaking of the foil, knows that the contents may have been tampered with.

A similar type of protection system is used for items sealed in a blister type of package. The package includes a backing sheet of foil or cardboard and a clear cover of sheet material which has been shaped to provide a plurality of receptacles which receive units of a product, such as pills or capsules. The plastic is sealed to the back, enclosing the pills. Here, tampering can sometimes be detected by opening any outer packaging and visually inspecting for puncture or tear marks anywhere along the back or in the plastic top. Tears in the packaging are more readily detected than punctures, however, which can be so small as to be invisible.

These prior art mechanisms suffer from the disadvantage that the user of the package must open the package before being able to discover whether the package has been tampered with. It is desirable, however, to have a package which may be inspected for tampering before purchase.

Accordingly, it is desirable to provide a tamper-proof package which overcomes the shortcomings of the prior art devices described above.

SUMMARY OF THE INVENTION

Generally speaking, in accordance with the present invention, an improved tamper-proof package is provided. The package includes a conductor of known electrical resistance, such as a wire or a trace of conductive ink incorporated internally in the package. The incorporated conductor is connected to terminals which are positioned on the package in such a way that they may be connected to an external device for determining whether or not the expected electrical resistance across the conductor is present. The conductor is incorporated in the package in such a way that opening the package to tamper with one of the contained articles alters the resistance of the circuit. The change in the electrical resistance of the circuit is determined by connecting the testing device to the terminals of a test circuit, so that, for example, a salesperson or the buyer can easily determine whether or not the package has been tampered with. The incorporated conductor may consist of a circuit which is made continuous at the outset so that, when measured during the shelf life of the product or at the time of sale, a short circuit or, preferably, a predetermined resistance is measured. In the alternative, the incorporated conductor may be a sandwich of two conductive layers with an insulating layer between. The sandwich presents an open circuit when it has not been tampered with, but presenting a short circuit or a low resistance to the testing device after tampering. In a preferred embodiment, the goods to be protected are enclosed in an envelope of the laminate.

Accordingly, it is an object of the invention to provide an improved tamper-proof package.

Another object of this invention is to provide a tamper-proof package which can reveal tampering of the package without the need for visual inspection.

A further object of this invention is to provide a tamper-proof package in which tampering with the package can be detected before opening the package.

A still further object of the invention is to provide a tamper-proof package which is useful for protecting packages containing drugs, foodstuffs, and other merchandise.

Still another object of this invention is to provide a tamper-proof package in which any tampering in the package may be detected before purchase of the package is made.

Still other objects and advantages of the invention will in part be obvious and will in part be apparent from the specification and drawings.

The invention accordingly comprises features of construction, combination of elements, and arrangements of parts which will be exemplified in the constructions hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a plan view, from below, of a tamper-proof package in which capsules are carried in blisters on a card;

FIG. 2 is an enlarged sectional view of the tamper-proof package taken along line 2—2 of FIG. 1;

FIG. 3 is an exploded view of a portion of the conductive portion of the tamper detection system of the invention;

FIG. 4 is a schematic circuit diagram of a circuit for testing the tamper-proof integrity;

FIG. 5 is a bottom plan view of a second embodiment of the tamper-proof package in accordance with the invention;

FIG. 6 is an enlarged partial sectional view of the package of FIG. 5 taken along line 6—6;

FIG. 7 is a perspective view of a circuit tester of the invention in use with a third embodiment of the tamper-proof package, shown in phantom;

FIG. 8 is an enlarged sectional view of portions of the third embodiment and the tester, taken along line 8—8 of FIG. 7;

FIG. 9 is a sectional plan view of the third embodiment, taken along line 9—9 of FIG. 8 with a part of the package broken away;

FIG. 10 is a sectional view of a fourth embodiment of a tamper-proof package in accordance with the teachings of the invention;

FIG. 11 is an enlarged partial sectional view of the invention embodiment of FIG. 10, taken along line 11—11;

FIG. 12 is a partial sectional view of the embodiment of FIG. 10 taken along line 12—12 of FIG. 11;

DETAILED DESCRIPTION OF THE PREFERRED EMBODIMENTS

Figure 13:
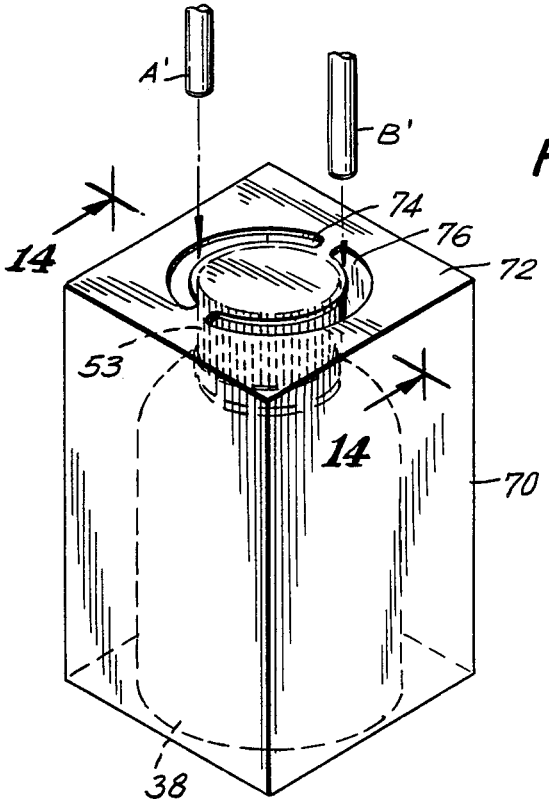
FIG. 13 is a perspective view showing the tamper-proof package of FIG. 10 enclosed in a box which provides access for testing.

Reference is first made to FIGS. 1, 2 and 3, where a tamper-proof package in accordance with the invention is shown, generally at 100. The package includes a card backing 1 and a blister top 2. Blister top 2 is transparent to allow visual inspection of the item contained within each blister 7; but this is a secondary inspection means in the present invention. Blister top 2 is securely sealed to backing card 1 by methods well known in the art so that no objects may be inserted therebetween after blister top 2 has been secured to card 1. A pill or capsule 3 is contained within each blister 7.

A printed ink conductor 4 is secured to the inside of blister top 2, tracing a path along blister top 2 so that it traverses each blister 7 therein. A contact 8, shown as a rivet, is affixed at each end of ink conductor 4 and imbedded in card 1. In the illustrative embodiment, a resistor 6 of predetermined value is connected in series with printed ink conductor 4, being secured to the material of top 2. Therefore, a circuit with a known total resistance comprising the resistance of conductor 4 plus that of resistor 6 is formed between the two contacts 8. It is to be understood that resistor 6 need not be provided when the resistance of conductive strip 4 is of a conveniently measurable value.

A second printed ink conductor 9, secured to card backing 1, is connected in series with a second resistor 10 of a predetermined resistance value as a second tamper detection circuit. Second printed ink conductor 9 traces a path along card 1 which is generally parallel to that of conductor 4, but which passes beneath each pill 3 and its blister 7. The ends of conductor 9 are also affixed to contacts 8, so that the second tamper detection circuit of known resistance is connected in parallel with the first circuit of known resistance to give a known resistance R between the contacts. It will be apparent to those skilled in the art that the two tamper detection circuits may also be arranged in a series connection (not shown) and that, where an impenetrable material is used for backing 1, or top 2, one of the two paths may be dispensed with. FIG. 3 illustrates a subassembly which can be used in components in the construction of the package of FIGS. 1 and 2 when it is desired to assemble pre-packaged components or to add protective circuits to already existing package components instead of fabricating the blister top and the backing with integral circuitry. In FIG. 3, conductors 4 and 9 are embedded or fastened to strips 4' and 9' of permanently adhesive backing material which are subsequently caused to adhere to the respective package parts.

A printed ink conductor in series with a resistor is used in the tamper detection circuit in the illustrative embodiment of FIGS. 1, 2 and 3. It will be apparent to those skilled in the art that the conductive path may be formed of transparent conductive materials, such as stannous oxide. Further, the conductive material may have a substantial resistance, and the series resistor can be omitted. Thus, a high resistance wire 12 without a resistor in series may be substituted therefor, in the manner shown in the embodiment of FIGS. 5 and 6. In FIG. 5, a wire 12 traces a path beneath each blister 7 and a second wire 12' traces a path within each blister 7. Except for wires 12' and 13, the numbers in FIGS. 5 and 6 are the same as those used in FIGS. 1, 2, and 3 for corresponding parts.

Reference is now made to FIG. 4, wherein a schematic diagram of a resistance testing circuit 13 useful in the practice of the invention is depicted. In FIG. 4 a power source 14 is connected between ground and a test contact A which, together with a second contact B, provide a pair of test terminals to which a package 100 whose integrity (resistance) is to be tested can be connected. The package to be tested is thus connected to voltage source 14 and to the input of circuit 13 which includes three variable resistors 17,18,19, two operational amplifiers 20 and 21, a fourth resistor 22 and a fifth resistor 23. Circuit 13 further includes a light-emitting diode 24, and an npn transistor 25. Test contact B is connected to input 27 of operational amplifier 21 and to input 31 of operational amplifier 20. The second input 28 of amplifier 21 is connected between one end of variable resistor 19 and the tap of variable resistor 18. The output 29 of operational amplifier 21 feeds into the base of transistor 25 and its voltage input 30 is grounded, as is the tap of variable resistor 19. The second input 32 of operational amplifier 20 is connected between the tap of variable resistor 17 and the fixed end of variable resistor 18. Voltage input 33 of operational amplifier 30 is energized by a voltage which is also applied to the fixed end of variable resistor 17 and to one end of dropping resistor 22. Output 34 of operational amplifier 20 is also connected to the input of npn transistor 25 as is the output 29 of operational amplifier 21.

The output of circuit 13 is developed in a circuit branch which includes a resistor 23, connected at one end to the voltage end of resistor 22 and at the other end to a light emitting diode 24. The other end of diode 24 is connected to the source of transistor 25. The emitter of transistor 25 is grounded. Operational amplifiers 20 and 21 may be quarter sections of a transistor package type 339 and transistor 25 may be a type RS-2009 npn transistor. Prior to use, circuit 13 is set by adjusting variable resistors 17, 18 and 19 by means of predetermined knob settings or, with a known resistance, such as that of an untampered-with package connected between points A and B, so that diode 24 will light. The diode will light when the tested package has the correct resistance value, but will not light for other values.

Circuit 13 may be contained in a housing 36 (see FIG. 7), which is configured to make ready electrical connection to the contacts of a cylindrical package under test. Housing 36 may of course be modified to provide test contact orientation which is appropriate for connecting with other package configurations as shown in FIG. 6.

When a package 100 such as that of FIG. 1 is correctly placed for testing, test contacts A and B connect with contacts 8 and circuit 13 is activated. Circuit 13 directly tests for deviations from the anticipated value in current flowing through the known resistance R of the test package. Variable resistors 17, 18, 19 are adjusted to provide a "window" or range of allowable resistance values so that when known resistance R is present and the anticipated level of current flows at the circuit input, light emitting diode 24 will turn on. When package 100 has been tampered with, either one or both of wires 4 or 9 will be broken by tampering, creating a resistance which differs from known resistance R and light 24 will remain unlit. If both wires are broken, no connection is made between contacts A and B, and diode 24 will not light. In the case when only one circuit is broken, a lower current than expected will pass into circuit 13, which current is not enough to activate diode 24. Again the light emitting diode will not operate, signalling tampering. It will be apparent to those skilled in the art that alterations may be made in the testing circuit without departing from the spirit of the invention. Such alterations include the supplying of an output inverter so that light emitting diode 24 lights when the package has been tampered with and the replacement of diode 24 with a noise producing device such as a buzzer or bell. It will be understood by those skilled in the art that the resistance measurement may be accomplished by using other testing devices, such as an ohmmeter which may have its usual scale replaced by one having a green sector for indicating "good" packages.

It is a feature of the invention that tampering with the package and then attempting to mask such tampering is prevented in a number of ways. First, if repair of a wire broken during tampering is attempted, the integrity of the package will be noticeably destroyed. This is due to the fact that high heat must be used in order to solder or weld a breach in the wire of bottom 1 or top 2. Both bottom 1 and top 2, being flammable or made of low melting point plastic, are easily damaged thereby. Secondly, in instances where a resistor is used in series connection in the conductor, the use of heat to remove and then replace the resistor, embedded as it is, would again destroy the packaging. Lastly, since the test circuit permits adjustment of the window of acceptable currents, the value of the package resistance can be changed from time to time with different production lots, or with different products, and the current settings of the resistors 17, 18 and 18 made known to the merchant. Thus, the "known" resistance value need only be known to the manufacturer, and the person who checks out the packages need only know the correct settings for the dials of the variable resistors. For a tamperer to succeed, he would therefore need to know the value of resistance he had to replace to produce the resistance R. Also, since each product lot may be given a resistance R which is associated with a date of production, the staleness of the package contents can be tested on a go-no-go basis. Only fresh lots having the up-to-date resistance value will test satisfactorily; goods which are stale will not.

Reference is now made to FIGS. 7, 8 and 9, where a second embodiment of the invention, depicted as an open-mouthed plastic container or bottle 38, is shown in place in a resistance tester 48 (FIG. 7). Container 38 has a mouth 40 which may be covered by an inner seal 42 of foil, heavy paper, or the like. A wire 43 runs across a diameter of mouth 40 under container top 39 from one side to the other. A resistor 44 of known value made of a crushable substance is connected in series with wire 43 and is partially embedded in top 39 below lip 45. Lip 45 of the top extends laterally outwards from container 38, to expose the ends 46 of wire 43 as they extend thereunder. Ends 46 of wire 43 are thus exposed to engage suitably located contacts A and B when placed in resistance tester 48 of FIG. 7. Resistance tester 48 contains a test circuit such as test circuit 13 of FIG. 4. Contacts A and B of the test circuit 46 are supported on posts 47 facing upwards so that they may come in contact with the respective ends of wire 43 (FIG. 8).

It is a feature of the embodiment of FIGS. 7, 8 and 9 that sharp, upward-facing ribs 49 are provided on the upper surface of flange 47 which extends radially around container mouth 40. If top 39 is turned, resistor 44 is carried over one of the ribs and will be, at least partially, crushed. Since the correct resistance cannot then be ascertained by testing and since the resistance is deliberately left unmarked, the tamperer cannot replace the resistance. If, as shown, top 39 is a standard child-proof top, a tab 50 thereon must be aligned with a groove 51 adjacent to mouth 40 in order to open the bottle. Resistor 44 must then encounter one of the ribs 49, thereby assuring that the resistance value of the circuit is changed. If the top has been tampered with or the package has been opened, light emitting diode 24 will not light on tester 48.

As with the first embodiment, a tamperer may try to prevent discovery that the circuit has been tampered with. Therefore, wire 43 is made of nickel chromium, which makes it extremely difficult to solder or weld a replacement resistor to the wire. In fact, the high temperature required for making a positive connection to a wire having such characterics would destroy bottle top 39. Further, since resistor 44 will have been significantly damaged by the tampering, any attempt to remove and replace it would result in incorrect readings by the tester. Again, to further increase safety, each new lot or product may be given a different resistance so that only the manufacturer of the goods will know the proper resistance value. It is to be understood that the previously described ink print conductor or the like may be utilized in lieu of wire 43.

Reference is now made to FIGS. 10–12, wherein a third embodiment of a tamper-proof package in accordance with the invention is applied to a narrow-necked bottle 38 which has a screw-off top 53. A rib 54 winds about the neck 55 of the bottle. Bottle top 53 contains a groove 52 which spirally engages rib 54. Top 53, when turned, ascends neck 55 and can eventually be lifted off of bottle 38. Bottle top 53 fits loosely so that it can be snapped into place when the bottle is first filled.

A wire 56 extends across bottle mouth 40, from one side to the other, and its ends 56 extend downward on either side in a fashion similar to the embodiment of FIGS. 7, 8 and 9. A resistor 63 is connected in series with wire 56, being imbedded or otherwise firmly secured on the inside of bottle top 53. The ends of wire 56 are brought into contact with contacts 57 which are positioned on the outer periphery of bottle top 53. Tester contacts A and B of the resistance tester (not shown) are positioned to engage contacts 57, when the package is inserted therebetween. Test circuit 13 (not shown) of the package tester functions as previously described so that diode 24 lights when the known resistance value R is present.

The third embodiment includes at least one rib 61 which is formed on neck 55 so as to project therefrom towards the inside of bottle top 53 at the level of resistor 63. When bottle top 53 is turned for removal, resistor 63 must pass over the sharp edge of rib 61, and be destroyed in the manner previously described. The wire and resistor assembly behaves in the same manner as previously described to prevent attempts to cover up any tampering. Also, printed ink conductors or the like may be substituted for wire 56, as described above. Resistor 58 is preferably partially embedded in the material of the cap so that removal is difficult.

Figure 14:
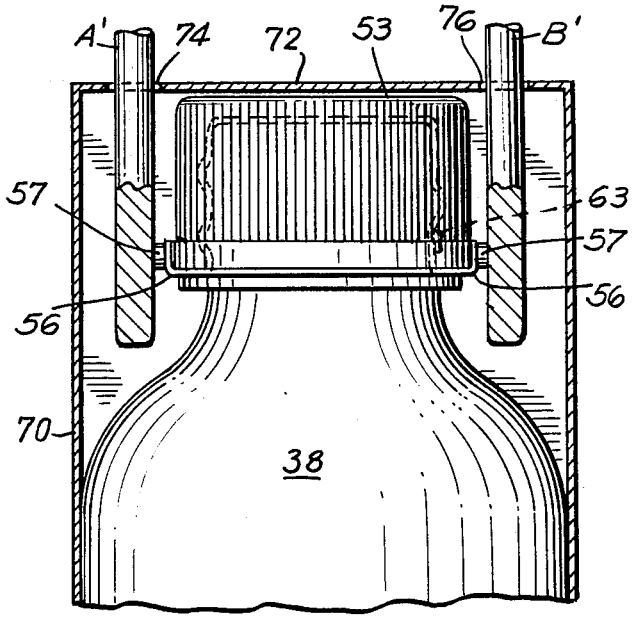
FIG. 14 is a view in partial cross section along lines 14—14 in FIG. 13 depicting the testing of the tamper-proof package within the box of FIG. 13.

FIGS. 13 and 14 illustrate a way in which the tamper-proof package of FIG. 10 can be further packaged for better display and stacking on a store shelf in an oblong, box-like container 70. Container 70 is generally conformably fitted to the diameter of bottle 38 and to the full height of bottle 38 when bottle top 53 is snapped closed thereon. To provide for examination of the bottle by testing the resistance of resistor 63 and series-connected wire 56, provision is made in top 72 of box 70 for the passage into the box of a contacts A′ and B′ of resistance tester. Contacts A′ and B′ are positioned, relative to each other, so that when introduced into box 70 via arcuate openings 74 and 76, they will make electrical connection with contacts 57 which are disposed on opposite sides of bottle top 53. In this embodiment, as was the case in the embodiment of FIG. 10, tester contacts A′ and B′ are modifications of contacts A and B of FIG. 7. Contacts A′ and B′ can be used with test circuit 13 of FIG. 4.

Figure 15:
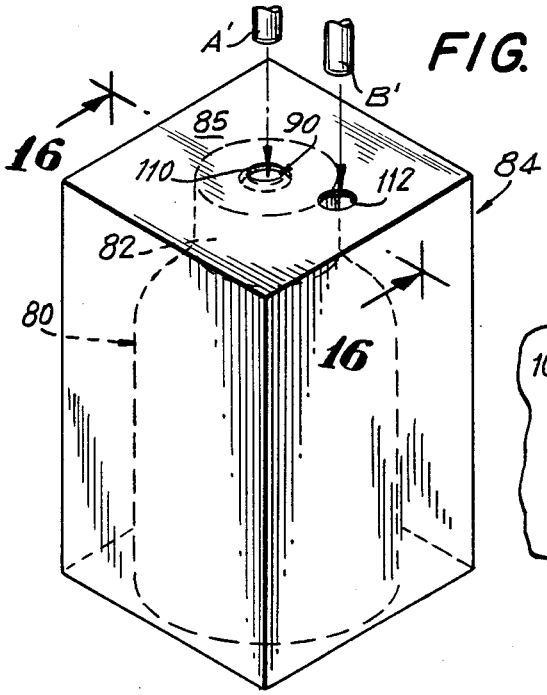
FIG. 15 is a perspective view of another box containing a tamper-proof package in accordance with the teachings of the invention.
Figure 17:
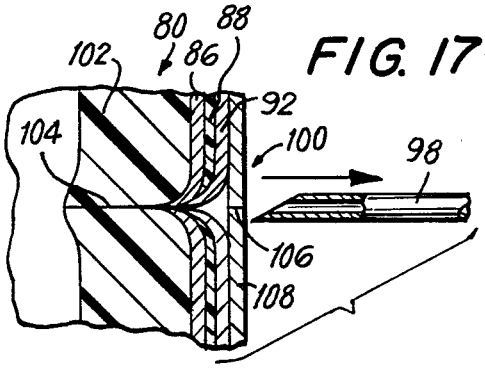
FIG. 17 is an enlarged sectional view of the tamper-proof package of FIGS. 15 and 16, depicting one manner of destroying the electrical integrity of the tamper-proof package depicted therein.
Figure 16:
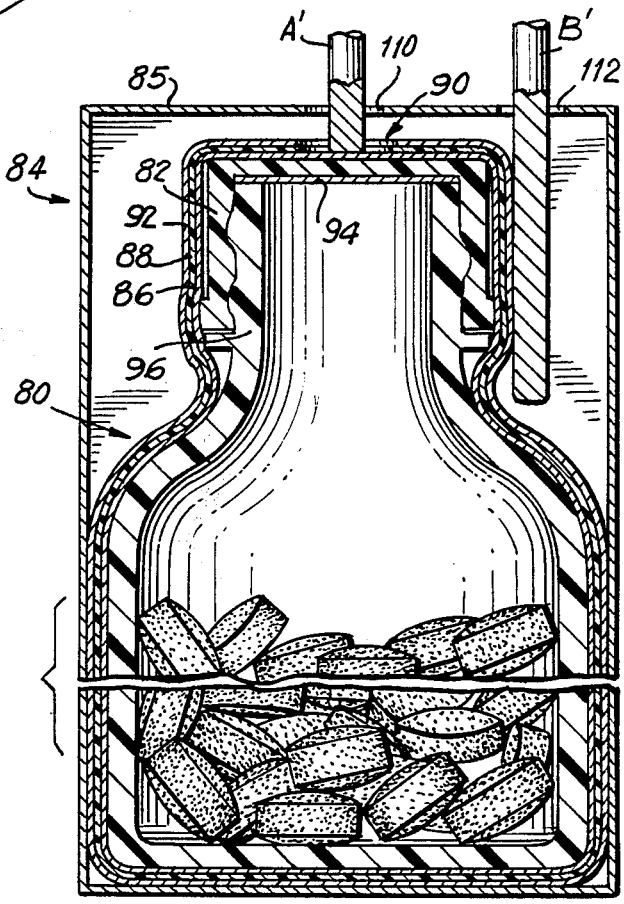
FIG. 16 is a view in partial cross section of the tamper-proof package of FIG. 15 within its shipping container.

A fourth embodiment of a tamper-proof package in accordance with the teachings of the invention is illustrated in FIGS. 15–17, where a narrow-necked bottle generally designated 80, and having a screw top 82, is enclosed within an oblong box 84. In this embodiment, the package is rendered tamper-proof by the presence of two conductive layers 86 and 92 which, together with an interposed insulating layer 88, enclose bottle 80 and bottle top 82.

As depicted in FIG. 16, bottle 80 and bottle top 82 are both made of plastic and are, by themselves, penetrable by a hypodermic needle for the introduction of adulterating material into the contents. Inner conducting layer 86 lies over the surfaces of bottle 80 and bottle cap 82. Insulating layer 88 extends over all of the vulnerable surfaces of the package except for one narrow opening 90 which, in the illustrative embodiment, lies in the center of bottle top 82. Lying on top of insulating layer 88 so as to be electrically isolated from the first layer is a second conductive layer 92. Layer 92 also has an opening which surrounds opening 90 in layer 88 so that a small area of first conductive layer 86 is left exposed. The conductive layers and the insulative layer form a sandwich. As will be seen in connection with FIG. 17, penetration of a pointed object, such as an hypodermic needle, into the package will damage insulating layer 88, so as to bring outer conducting layer 92 and inner conductive layer 86 together. A simple well-known conductivity test, for example, by means of an ohmmeter or a light in series with a power source such as an LED and a battery will, in such case, show the existence of a short circuit between the two conductive layers. To protect against penetration for tampering with the material of bottle top 82 in unprotected region 90, a penetration-resistant disc 84, which may be made of metal, is interposed between the downward-facing surface of bottle top 82 and the lip of bottle neck 96.

FIG. 17 illustrates the way a penetrating object, such as the needle 98 of a hypodermic (shown being withdrawn), causes extrusion of the sandwich, so damaging insulating layer 88, between conductive layer 86 and conducting layer 92, during its passage into and out of bottle 80, that contact between the conductive layers results. Thus, as shown in FIG. 17 at area 100, the wall 102 of bottle 80 has been completely penetrated by the needle at 104, causing deformation of the plastic of the bottle and extrusive deformation of the inner conductive, insulating, and outer conductive layers 86, 88, and 92. The integrity of insulating layer 88 is destroyed, allowing the extruded material of outer conductive layer 92 to contact inner conductive layer 86. Thus, even though the point of penetration 106 of needle 98 into wall 108 of box 84 may have become substantially invisible after withdrawal of needle 98, the connection established between inner conductive layer 86 and outer conductive layer 92 remains and can be electrically detected.

As stated above, the laminate which forms the envelope around the package goods of FIGS. 16 and 17 is so constructed that penetration by a sharp object results in extrusion of the sandwich or laminate and consequent short-circuiting together of its outer and inner layers. The term extrusion, as used herein, describes the flow or other movement of the material of one conductive layer, through a breach in the separating insulating layer, into contact with the other layer as a result of the penetration of the layers by a pointed object. Such an extrudable sandwich structure can be made of two layers of aluminum of one mil thickness which are spaced apart by a three mil dielectric layer of acrylic-impregnated tissue paper. Other extrudable metals, such as copper, and other insulators, such as metallized mylar and the like, can be used.

The manner of checking for damage to the enclosing layers of bottle 80 is illustrated in FIGS. 15 and 16, where the top 85 of box 84 is provided with a central aperture 110 and a laterally displaced aperture 112 by means of which a pair of conducting test probes A′, B′, can be inserted. Test probe A′ passes through passage opening 110 and central opening 90 of the bottle top assembly to contact the exposed surface of inner conductive layer 86. Test probe B′ passes through opening 112 in box 80 into contact with outer conductive layer 92. A simple conductivity measurement made by means of an ohmmeter or the like between probes A′ and B′ will quickly reveal whether insulating layer 88 is intact or whether, indeed, there has been damage thereto by a tamperer. In the latter event the ohmmeter will not show an open circuit.

While the use of a close-fitting laminate as an envelope for a protective package has been illustrated in the FIGS. 15–17, it will be apparent that the envelope need not be close-fitting but that it can up be made in the form of a bag or balloon which encloses the protected container or as a laminated layer on the inside of the box in which the protected container is being shipped or displayed for purchase. It will also be apparent that the enclosing laminate of the invention can be combined with a seal which provides for visual detection of tampering. For example, if the closure member or an associated structural element is hard to penetrate, the closure member can be left uncovered, with the enclosing laminate extending thereunder. Then, removal of a surrounding seal will produce a noticeable disturbance of the original arrangement of the laminate. Also, a conventional protective strip can be applied over the junction of the closure member and the container to provide the usual visual evidence of removal of the closure member.

Accordingly, by providing a tamper-proof package with a conductor of a known resistance which is adapted to be measured externally of the package without alteration thereof, the conductor being positioned in the package so that the resistance of the circuit formed by the conductor will be significantly altered if any attempt is made to open the package, tampering with packaged articles is greatly deterred.

It will thus be seen that the objects set forth above, among those made apparent from the preceding description, are efficiently attained and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A tamper-proof package for enclosing material, the package comprising:

container means for holding material, the container means having an opening through which the material may be inserted and removed;

closure means coupled to the container means for closing the opening;

circuit means having an electrical resistance of known value located on at least one of the container means and the closure means, the circuit means being so positioned that the tampering with the container means will alter the known value of the circuit means; and terminal means connected to the circuit means on the exterior of at least one of the container means and the closure means for testing the resistance of the circuit means wherein the circuit means further comprises:

an enclosure having a first conductive layer in which at least the container means is enclosed;

a layer of insulating material extending over the first conductive layer; and a second conductive layer extending over the insulating layer, the known value of the resistance of the circuit means comprising a substantially open-circuit value when the envelope has not been tampered with, the open-circuit value being altered to a substantially short-circuit value when the envelope has been tampered with.

2. The tamper-proof package of claim 1 wherein the closure means is also enclosed, and further comprising:

superposed openings in the layer of insulating material and the second conducting layer which expose the surface of first conductive layer to provide a terminal means.

3. The tamper-proof package of claim 2 wherein the closure means comprises a removable cap and wherein the superposed openings through which the first conductive layer is exposed are located on the outer surface of the cap.

4. The tamper-proof package of claim 3 and further comprising:

penetration resistant means underlying at least the the superposed openings, the penetration resistant means lying beneath the cap.

5. The tamper-proof package of claim 3 wherein the access means is positioned adjacent to the cap of the container means.

6. A tamper-proof package for holding material comprising:

container means including a receptacle for holding material and a closure member;

envelope means enclosing the container means for detecting tampering therewith, the envelope means comprising an enclosing surface having a first layer of conductive material, a second layer of insulating material, and a third layer of conductive material, at least one of the layers of conductive material being extrudable into contact with the other layer of conductive material through the layer of insulating material when the enclosing surface is penetrated; and means for making electrical connection to the conducting layers to determine whether or not the conductive layers are in contact with each other.

7. The tamper-proof package of claim 6 wherein the material of the conducting layers comprises an extrudable metal.

* * * * *